US005885376A

United States Patent [19]

Suzuki et al.

[11] Patent Number: 5,885,376

[45] Date of Patent: Mar. 23, 1999

[54] CORROSION-RESISTANT HIGH-STRENGTH COPPER BASED ALLOY HAVING EXCELLENT BLANKABILITY

[75] Inventors: Takeshi Suzuki; Manpei Kuwahara; Shin Kikuchi; Yoshiharu Mae; Junichi Kumagai; Katsuyoshi Narita, all of Aizuwakamatsu; Rensei Futatsuka, Tokyo, all of Japan

[73] Assignee: Mitsubishi Shindoh Co., Ltd., Tokyo, Japan

[21] Appl. No.: 58,329

[22] Filed: Apr. 9, 1998

[30] Foreign Application Priority Data

Apr. 14, 1997 [JP] Japan ..... 9-095585
Apr. 18, 1997 [JP] Japan ..... 9-101603

[51] Int. Cl.[6] ..... C22C 9/04

[52] U.S. Cl. ..... 148/434; 148/400; 420/481

[58] Field of Search ..... 148/400, 434; 420/481, 478, 479, 480

[56] References Cited

FOREIGN PATENT DOCUMENTS

| | | |
|---|---|---|
| 63-230837 | 9/1988 | Japan . |
| 1079334 | 3/1989 | Japan . |
| 5-171320 | 7/1993 | Japan . |

OTHER PUBLICATIONS

Patent Abstracts of Japan, vol. 095, No. 009, Oct. 1995, Abstract of JP 07 166279 A (Kobe Steel Ltd.), Jun. 1995.

Patent Abstracts of Japan, vol. 017, No. 589 (C–1124), Oct. 1993, Abstract of JP 05 171320 A (Mitsubishi Shindoh Co. Ltd.), Jul. 1993.

Patent Abstracts of Japan, vol. 018, No. 668 (C–1289), Dec., 1994, Abstract of JP 06 264166 A (Kobe Steel Ltd.), Sep. 1994.

Patent Abstracts of Japan, vol. 018, No. 285 (C–1206), May 1994, Abstract of JP 06 049564 A (Kobe Steel Ltd.), Feb. 1994.

Patent Abstracts of Japan, vol. 018, No. 128 (C–1174), Mar. 1994, Abstract of JP 05 311290 A (Kobe Steel Ltd.), Nov. 1993.

Patent Abstracts of Japan, vol. 017, No. 309 (C–1070), Jun. 1993, Abstract of JP 05 025567 A (Mitsubishi Shindoh Co. Ltd.), Feb. 1993.

Patent Abstracts of Japan, vol. 015, No. 302 (C–0855), Aug. 1991, Abstract of JP 03 111529 A (Nippon Mining Co. Ltd.), May 1991.

*Primary Examiner*—Sikyin Ip
*Attorney, Agent, or Firm*—Frishauf, Holtz, Goodman, Langer & Chick, P.C.

[57] ABSTRACT

A copper based alloy consists essentially, by weight %, of 15 to 35% Zn, 7 to 14% Ni, 0.1 to 2% or less Mn, 0.01 to 0.5% Fe, 0.0005 to 0.1% P, at least one or two elements selected from the group consisting of 0.001 to 0.9% Si, 0.0003 to 0.02% Pb, and 0.0003 to 0.01% C, the total content of the selected at least two elements being limited to a range of 0.0006 to 0.9%, and the balance of Cu and inevitable impurities. The copper based alloy has excellent blankability as well as good corrosion resistance and high strength.

21 Claims, 1 Drawing Sheet

FIGURE
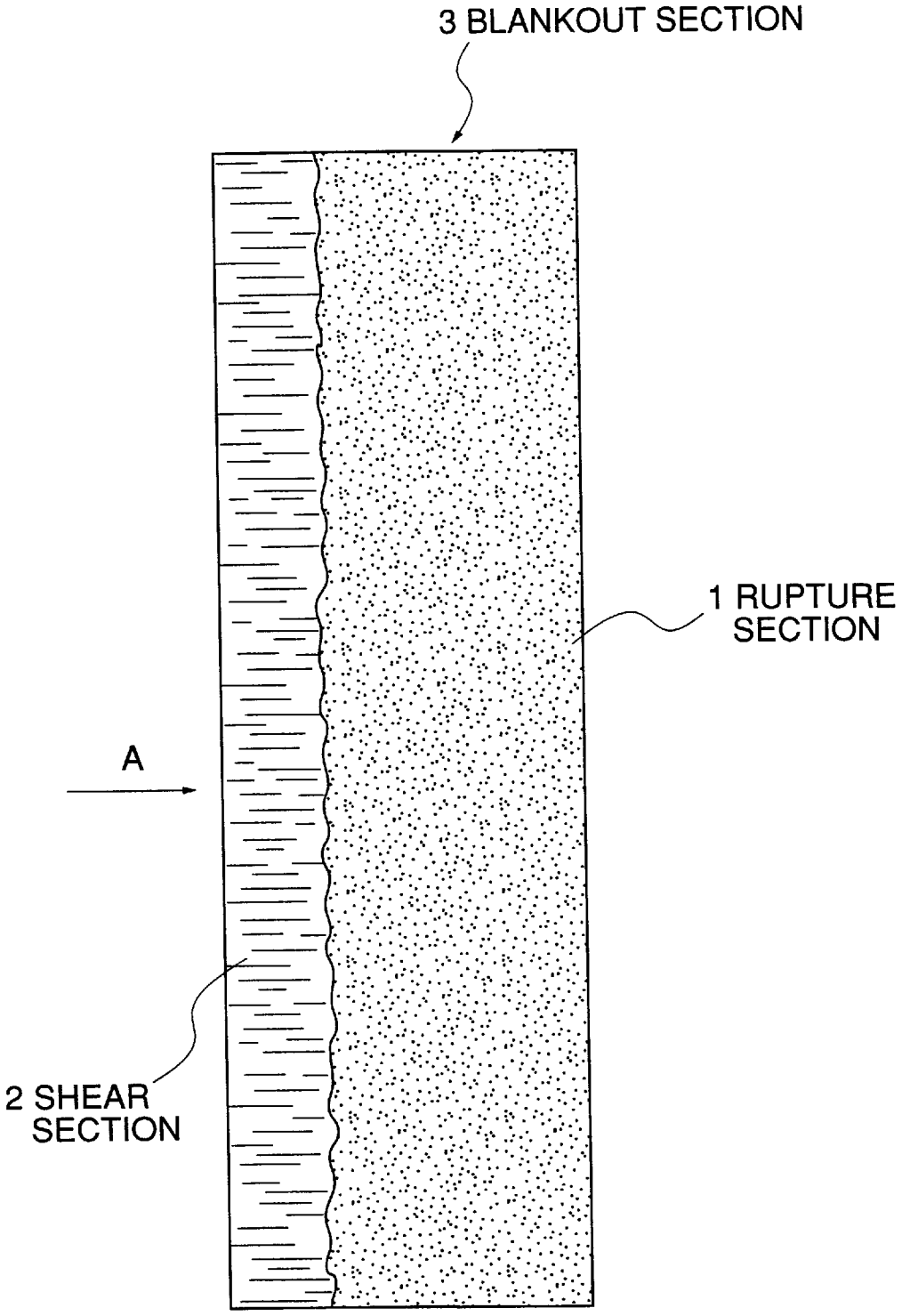

CORROSION-RESISTANT HIGH-STRENGTH COPPER BASED ALLOY HAVING EXCELLENT BLANKABILITY

BACKGROUND OF THE INVENTION

1. Field of the Invention

This invention relates to a copper based alloy having excellent blankability as well as good corrosion resistance and high strength, which is suitable for use as materials for electrical and electronic parts, such as lead frames, terminals, connectors, and caps for crystal oscillators, keys, springs, buttons, tableware, ornaments, and golf clubs. Especially, a copper based alloy according to the invention exhibits excellent effects when used as a material for keys.

2. Prior Art

Conventionally, brass having a typical composition of Cu-40% by weight Zn is widely used as a material for keys (hereinafter referred to as "the key material"). However, brass is poor in strength and corrosion resistance, resulting in that keys formed of brass are likely to corrode, and further, they can be deformed when they are made thinner to be lighter in weight. To overcome these disadvantages, there has been proposed a key material formed of a high-strength copper based alloy (hereinafter referred to as "the Cu alloy") which is excellent in corrosion resistance, for example, by Japanese Laid-Open Patent Publication (Kokai) No. 5-171320. The Cu alloy has a chemical composition consisting essentially, by weight percent (hereinafter referred to as "%"), of 15 to 35% Zn, 7 to 14% Ni, 0.1 to 2% exclusive Mn, 0.01 to 0.5% Fe, 0.001 to 0.1% p, and the balance of Cu and inevitable impurities.

Although the above proposed high-strength Cu alloy is excellent in corrosion resistance, it is poor in blankability. As a result, keys manufactured by blanking or stamping the high-strength Cu alloy key material has a blankout section which does not have satisfactorily close dimensional tolerances.

Generally, a blankout section 3 of a key obtained by blanking a Cu alloy key material in the direction indicated by an arrow A in the single figure consists of a shear section 2 and a rupture section 1, and in evaluation of the key material, it is regarded that the larger a ratio of the rupture section 1 to the entire blankout section 3 (hereinafter referred to as "rupture section ratio"), the more excellent in blankability the key material. A blankout sheet material is generally required to have a rupture section ratio of 75% or more.

When the above proposed high-strength Cu alloy key material is subjected to blanking to obtain keys, however, the blankout section 3 of the resulting keys has a rupture section ratio less than the required value of 75%. As a result, blanking dies used to blank the high-strength Cu alloy key material become shorter in service life, and further the blankout section of the keys does not have satisfactorily close dimensional tolerances, which unfavorably leads to a shortened service life of the dies as well as an increased amount of after-treatment, and hence an increased manufacturing cost.

SUMMARY OF THE INVENTION

It is a first object of the invention to provide a Cu alloy having excellent blankability as well as good corrosion resistance and high strength.

It is a second object of the invention to provide a key material, a material for electrical and electronic parts, and a material for springs, which are formed of a Cu alloy of the preceding object.

To attain the first object, according to a first aspect of the invention, there is provided a Cu alloy consisting essentially, by weight %, of:

15 to 35% Zn, 7 to 14% Ni, 0.1 to 2% exclusive Mn, 0.01 to 0.5% Fe, 0.0005 to 0.1% P, 0.001 to 0.9% Si, and the balance of Cu and inevitable impurities.

To attain the same object, according to a second aspect of the invention, there is provided a Cu alloy consisting essentially, by weight %, of:

15 to 35% Zn, 7 to 14% Ni, 0.1 to 2% exclusive Mn, 0.01 to 0.5% Fe, 0.0005 to 0.1% P, 0.0003 to 0.02% Pb, and the balance of Cu and inevitable impurities.

To attain the same object, according to a third aspect of the invention, there is provided a Cu alloy consisting essentially, by weight %, of:

15 to 35% Zn, 7 to 14% Ni, 0.1 to 2% exclusive Mn, 0.01 to 0.5% Fe, 0.0005 to 0.1% P, 0.0003 to 0.01% C, and the balance of Cu and inevitable impurities.

To attain the same object, according to a fourth aspect of the invention, there is provided a Cu alloy consisting essentially, by weight %, of:

15 to 35% Zn, 7 to 14% Ni, 0.1 to 2% exclusive Mn, 0.01 to 0.5% Fe, 0.0005 to 0.1% P, 0.0006 to 0.9% in total at least two elements selected from the group consisting of 0.001 to 0.9% Si, 0.0003 to 0.02% Pb, and 0.0003 to 0.01% C, and the balance of Cu and inevitable impurities.

Preferably, the Cu alloy further includes 0.01 to 2% in total at least one element selected from the group consisting of Al, Mg, Sn, Ti, Cr, Zr, Ca, Be, V, Nb, and Co.

According to the first aspect, preferably, the Cu alloy consists essentially, by weight %, of:

30 to 34% Zn, 8 to 12% Ni, 0.5 to 1.8% Mn, 0.02 to 0.2% Fe, 0.001 to 0.01% P, 0.004 to 0.3% Si, and the balance of Cu and inevitable impurities.

According to the second aspect, preferably, the Cu alloy consists essentially, by weight %, of:

30 to 34% Zn, 8 to 12% Ni, 0.5 to 1.8% Mn, 0.02 to 0.2% Fe, 0.001 to 0.01% P, 0.0006 to 0.008% Pb, and the balance of Cu and inevitable impurities.

According to the third aspect, preferably, the Cu alloy consists essentially, by weight %, of:

30 to 34% Zn, 8 to 12% Ni, 0.5 to 1.8% Mn, 0.02 to 0.2% Fe, 0.001 to 0.01% P, 0.0005 to 0.005% C, and the balance of Cu and inevitable impurities.

More preferably, the Cu alloy further includes 0.06 to 0.9% in total at least one element selected from the group consisting of Al, Mg, Sn, Ti, Cr, Zr, Ca, Be, V, Nb, and Co.

Advantageously, the inevitable impurities contain 0.0005 to 0.01% S and 0.0005 to 0.01% O.

To attain the second object, the present invention provides a key material, a material for electrical and electronic parts, and a material for springs, which are formed of any of the Cu alloys stated as above.

The above and other objects, features and advantages of the invention will be more apparent from the following detailed description taken in conjunction with the accompanying drawing.

BRIEF DESCRIPTION OF THE DRAWING

A single FIGURE is a sectional view which is useful in explaining a blankout section obtained by performing blanking.

DETAILED DESCRIPTION

Under the aforestated circumstances, the present inventors have made studies in order to obtain a high-strength Cu alloy which is not only excellent in corrosion resistance but also in blankability, and have reached the following findings:

(a) If one element selected from the group consisting of 0.001 to 0.9% Si, 0.0003 to 0.02% Pb, and 0.0003 to 0.01% C, is added to a Cu alloy having a chemical composition consisting essentially of 15 to 35% Zn, 7 to 14% Ni, 0.1 to 2 exclusive Mn, 0.01 to 0.5% Fe, 0.0005 to 0.1% P, and the balance of Cu and inevitable impurities, or alternatively at least two elements selected from the above group with a total content thereof being 0.0006 to 0.9% are added to the same Cu alloy, the resulting Cu alloy not only maintains good corrosion resistance and high strength but also exhibits excellent blankability;

(b) If at least one element selected from the group consisting of Al, Mg, Sn, Ti, Cr, Zr, Ca, Be, V, Nb, and Co with a total content thereof being 0.01 to 2% is added to the Cu alloy mentioned under the preceding paragraph (a), the strength of the Cu alloy is further enhanced; and (c) If the S and 0 contents in the inevitable impurities of the Cu alloy mentioned under the paragraph (a) or (b) are limited to respective ranges of 0.0005 to 0.01% and 0.0005 to 0.01, a Cu alloy having further preferable properties is obtained.

(d) The high-strength Cu alloy mentioned under any of the paragraphs (a) to (c) is suitable for use not only as a key material, but also as a material for electrical and electronic parts, such as lead frames, terminals, connectors, and caps for crystal oscillators, a material for springs, buttons, tableware, ornaments, and golf clubs.

The present invention is based upon the above findings.

The contents of the component elements of the Cu alloy according to the present invention have been limited as stated above, for the following reasons:

(A) Zn

The Zn component acts to improve the strength of the Cu alloy. However, if the Zn content is less than 15%, desired strength cannot be ensured, whereas if the Zn content exceeds 35%, the Cu alloy has degraded cold rollability. Therefore, the Zn content has been limited to the range of 15 to 35%, and preferably to a range of 30 to 34%.

(B) Ni

The Ni component acts to improve the strength, elongation (tenacity), and corrosion resistance. However, if the Ni content is less than 7%, the above-mentioned action cannot be achieved to a desired extent, whereas if the Ni content exceeds 14%, the Cu alloy has degraded hot rollbility. Therefore, the Ni content has been limited to the range of 7 to 14%, and preferably to a range of 8 to 12%.

(C) Mn

The Mn component acts to further improve the effects of strength, elongation, and corrosion resistance brought about by the Ni component. However, if the Mn content is less than 0.1%, the above action cannot be achieved to a desired extent, whereas if the Mn content is 2% or more, the Cu alloy has increased viscosity when melted, to degrade the castability of the same. Therefore, the Mn content has been limited to the range of 0.1 to 2% exclusive, and preferably to a range of 0.5 to 1.8%.

(D) Fe

The Fe component acts to improve the corrosion resistance. However, if the Fe content is less than 0.01%, the above action cannot be achieved to a desired extent, whereas if the Fe content exceeds 0.5%, the corrosion resistance tends to degrade. Therefore, the Fe content has been limited to the range of 0.01 to 0.5%, and preferably to a range of 0.02 to 0.2%.

(E) P

The P component acts to further improve the effect of corrosion resistance brought about by the Fe component. However, if the P content is less than 0.0005%, desired corrosion resistance cannot be ensured. On the other hand, if the P content exceeds 0.1%, the effect of corrosion resistance is saturated, whereby further improvement in the corrosion resistance is not exhibited. Therefore, the P content has been limited to the range of 0.0005 to 0.1%, and preferably to a range of 0.001 to 0.01%.

(F) Si, Pb, and C

Addition of each of the Si, Pb, and C components to the Cu alloy serves to increase the rupture section ratio of the blankout section, to thereby reduce the amount of wear of the blanking die. However, when only one of the above components is added, if the Si content is below 0.001%, the Pb content below 0.0003%, or the C component is below 0.0003%, the above action cannot be achieved to a desired extent. On the other hand, if the Si content exceeds 0.9%, the Pb content 0.02%, or the C content 0.01%, the hot rollability of the Cu alloy is adversely affected. Therefore, the Si content has been limited to the range of 0.001 to 0.9%, the Pb content to the range of 0.0003 to 0.02%, and the C content to the range of 0.0003 to 0.01%. Preferably, the Si content should be limited to a range of 0.004 to 0.3%, the Pb content to a range of 0.0006 to 0.008%, and the C content to a range of 0.0005 to 0.005%. Among the Si, Pb, and C components, the Si component is the most effective for improving all of the strength, the corrosion resistance, and the blankability. Two or more of the Si, Pb, and C components may be contained in the Cu alloy, and in such a case, the total content of the Si, Pb, and C components must be limited to the range of 0.0006 to 0.9%. If the total content of these components is less than 0.0006%, the rupture section ratio of the blankout section cannot be increased to a sufficient value, whereas if the total content of the same exceeds 0.9%, the hot rollability of the Cu alloy is adversely affected. Therefore, the total content of the Si, Pb, and C components has been limited to the above-mentioned range and preferably to a range of 0.001 to 0.3%. If two or more of the Si, Pb, and C components are contained, it is preferable that the Si component should be added as an essential component.

(G) Al, Mg, Sn, Ti, Cr, Zr, Ca, Be, V, Nb, and Co

These components may be contained in the Cu alloy if required, because they are each solid solved in the alloy matrix, precipitate, and form oxides, sulfides, and carbides thereof to thereby further improve the strength of the Cu alloy. However, if the total content of at least one of the components is less than 0.01%, the above-mentioned action cannot be achieved to a desired extent, whereas if the total content exceeds 2%, the hot rollability of the alloy is adversely affected. Therefore, the total content of at least one of the component elements has been limited to the range of 0.01 to 2%, and preferably to a range of 0.06 to 0.9%.

(H) S and O

The S and O components are present in the Cu alloy as inevitable impurities. However, if the S and O contents are less than 0.0005% and 0.0005%, respectively, the rupture section ratio of the blankout section cannot be increased to a sufficient value, whereas if these contents exceed 0.01% and 0.01%, respectively, the hot rollability of the alloy is adversely affected. Therefore, the S and O contents have been limited to the range of 0.0005 to 0.01% and 0.0005 to 0.01%, respectively.

Examples of the invention will now be described hereinbelow.

EXAMPLE 1

Molten Cu alloys Nos. 1 to 56 according to the present invention having chemical compositions shown in Tables 1 to 7, and molten comparative Cu alloys Nos. 1 to 6 and a molten conventional Cu alloy having chemical compositions shown in Table 8 were prepared in a low-frequency channel smelting furnace in the atmospheric air with the surfaces of the molten alloys covered with charcoal, or alternatively in an reducing gas atmosphere. The thus prepared molten Cu alloys were cast by a semicontinuous casting method into billets each having a size of 400 mm in width, 1500 mm in length, and 100 mm in thickness. The billets were each hot rolled at an initial hot rolling temperature within a range of 750° to 870° C. and at a final hot rolling temperature within a range of 450° to 550° C. into hot rolled plates each having a thickness of 11 mm. The hot rolled plates were each quenched and then had its upper and lower sides scalped by 0.5 mm, to thereby remove scales therefrom. The resulting plates were cold rolled to prepare cold rolled plates each having a thickness of 3.6 mm, and then annealed at a predetermined temperature within a range of 400° to 650° C. for one hour. Further, the thus annealed plates were subjected to pickling and polishing, followed by final cold rolling, to thereby reduce the thickness of the Cu alloy plates to 3 mm. Thus, Cu alloy sheets Nos. 1 to 56 according to the present invention, comparative Cu alloy sheets Nos. 1 to 6, and conventional Cu alloy sheet were produced.

The comparative Cu alloys Nos. 1 to 6 each have one or more of the components falling outside the range of the present invention. Adjustment of the C content of the Cu alloys Nos. 1 to 56 of the present invention and the comparative Cu alloys Nos. 1 to 6 was carried out by inserting a graphite bar with the surface thereof covered with a graphite solid material into the molten alloy, and controlling the melting time. Further, adjustment of the S content of the Cu alloys was carried out by desulfuration mainly by adding a Cu—Mn mother alloy, and, if required, by adding a copper sulfide. Still further, adjustment of the O content of the Cu alloys was carried out by controlling the melting atmosphere, deoxidization mainly by adding a Cu—P mother alloy, and, if required, by blowing air into the molten alloy.

TABLE 1

| CHEMICAL COMPOSITION | Cu ALLOYS OF PRESENT INVENTION | | | | | | | |
|---|---|---|---|---|---|---|---|---|
| (wt %) | 1 | 2 | 3 | 4 | 5 | 6 | 7 | 8 |
| Zn | 15.8 | 24.6 | 34.5 | 32.1 | 31.8 | 31.7 | 32.2 | 32.1 |
| Ni | 9.5 | 9.4 | 9.8 | 7.8 | 13.1 | 9.7 | 9.5 | 9.7 |
| Mn | 1.03 | 9.98 | 1.04 | 1.49 | 1.47 | 0.13 | 1.95 | 1.45 |
| Fe | 0.27 | 0.22 | 0.23 | 0.031 | 0.025 | 0.028 | 0.033 | 0.013 |
| P | 0.040 | 0.045 | 0.047 | 0.002 | 0.003 | 0.003 | 0.002 | 0.002 |
| Si | 0.001 | 0.005 | 0.021 | 0.075 | 0.102 | 0.126 | 0.158 | 0.212 |
| Pb | — | — | — | — | — | — | — | — |
| C | — | — | — | — | — | — | — | — |
| Al | — | — | — | — | — | — | — | — |
| Mg | — | — | — | — | — | — | — | — |
| Sn | — | — | — | — | — | — | — | — |
| Ti | — | — | — | — | — | — | — | — |
| Cr | — | — | — | — | — | — | — | — |
| Zr | — | — | — | — | — | — | — | — |
| Ca | — | — | — | — | — | — | — | — |
| Be | — | — | — | — | — | — | — | — |
| V | — | — | — | — | — | — | — | — |
| Nb | — | — | — | — | — | — | — | — |
| Co | — | — | — | — | — | — | — | — |
| S | 0.0008 | 0.0009 | 0.0012 | 0.0023 | 0.0015 | 0.0018 | 0.0013 | 0.0035 |
| O | 0.0010 | 0.0006 | 0.0005 | 0.0013 | 0.0015 | 0.0009 | 0.0016 | 0.0007 |
| Cu | BAL. | BAL. | BAL. | BAL. | BAL. | BAL. | BAL. | BAL. |

TABLE 2

| CHEMICAL COMPOSITION | Cu ALLOYS OF PRESENT INVENTION | | | | | | | |
|---|---|---|---|---|---|---|---|---|
| (wt %) | 9 | 10 | 11 | 12 | 13 | 14 | 15 | 16 |
| Zn | 31.9 | 31.8 | 34.8 | 32.2 | 32.1 | 31.9 | 31.8 | 32.0 |
| Ni | 10.0 | 9.6 | 9.9 | 7.1 | 13.6 | 9.8 | 9.5 | 9.8 |
| Mn | 1.46 | 1.48 | 1.51 | 1.49 | 1.47 | 0.12 | 1.98 | 1.45 |
| Fe | 0.026 | 0.031 | 0.030 | 0.028 | 0.027 | 0.032 | 0.031 | 0.011 |

TABLE 2-continued

| CHEMICAL COMPOSITION | Cu ALLOYS OF PRESENT INVENTION | | | | | | | |
|---|---|---|---|---|---|---|---|---|
| (wt %) | 9 | 10 | 11 | 12 | 13 | 14 | 15 | 16 |
| P | 0.001 | 0.098 | 0.0005 | 0.002 | 0.001 | 0.003 | 0.002 | 0.002 |
| Si | 0.303 | 0.521 | 0.751 | 0.890 | — | — | — | — |
| Pb | — | — | — | — | 0.0004 | 0.0009 | 0.0015 | 0.0027 |
| C | — | — | — | — | — | — | — | — |
| Al | — | — | — | — | — | — | — | — |
| Mg | — | — | — | — | — | — | — | — |
| Sn | — | — | — | — | — | — | — | — |
| Ti | — | — | — | — | — | — | — | — |
| Cr | — | — | — | — | — | — | — | — |
| Zr | — | — | — | — | — | — | — | — |
| Ca | — | — | — | — | — | — | — | — |
| Be | — | — | — | — | — | — | — | — |
| V | — | — | — | — | — | — | — | — |
| Nb | — | — | — | — | — | — | — | — |
| Co | — | — | — | — | — | — | — | — |
| S | 0.0009 | 0.0015 | 0.0025 | 0.0018 | 0.0016 | 0.0011 | 0.0014 | 0.0009 |
| O | 0.0008 | 0.0009 | 0.0008 | 0.0006 | 0.0009 | 0.0012 | 0.0008 | 0.0015 |
| Cu | BAL. | BAL. | BAL. | BAL. | BAL. | BAL. | BAL. | BAL. |

TABLE 3

| CHEMICAL COMPOSITION | Cu ALLOYS OF PRESENT INVENTION | | | | | | | |
|---|---|---|---|---|---|---|---|---|
| (wt %) | 17 | 18 | 19 | 20 | 21 | 22 | 23 | 24 |
| Zn | 32.3 | 31.8 | 31.8 | 32.2 | 32.0 | 31.9 | 31.8 | 31.9 |
| Ni | 9.5 | 10.1 | 9.8 | 7.1 | 13.6 | 9.8 | 10.0 | 9.7 |
| Mn | 1.46 | 1.45 | 1.53 | 1.47 | 1.45 | 0.13 | 1.91 | 1.45 |
| Fe | 0.031 | 0.030 | 0.029 | 0.027 | 0.027 | 0.030 | 0.031 | 0.012 |
| P | 0.001 | 0.083 | 0.0006 | 0.002 | 0.003 | 0.005 | 0.002 | 0.001 |
| Si | — | — | — | — | — | — | — | — |
| Pb | 0.0038 | 0.0051 | 0.0072 | 0.0096 | 0.0134 | 0.0156 | 0.0178 | 0.019 |
| C | — | — | — | — | — | — | — | — |
| Al | — | — | — | — | — | — | — | — |
| Mg | — | — | — | — | — | — | — | — |
| Sn | — | — | — | — | — | — | — | — |
| Ti | — | — | — | — | — | — | — | — |
| Cr | — | — | — | — | — | — | — | — |
| Zr | — | — | — | — | — | — | — | — |
| Ca | — | — | — | — | — | — | — | — |
| Be | — | — | — | — | — | — | — | — |
| V | — | — | — | — | — | — | — | — |
| Nb | — | — | — | — | — | — | — | — |
| Co | — | — | — | — | — | — | — | — |
| S | 0.0018 | 0.0012 | 0.0012 | 0.0018 | 0.0025 | 0.0006 | 0.0027 | 0.0093 |
| O | 0.0089 | 0.0025 | 0.0014 | 0.0015 | 0.0012 | 0.0028 | 0.0022 | 0.0017 |
| Cu | BAL. | BAL. | BAL. | BAL. | BAL. | BAL. | BAL. | BAL. |

TABLE 4

| CHEMICAL COMPOSITION | Cu ALLOYS OF PRESENT INVENTION | | | | | | | |
|---|---|---|---|---|---|---|---|---|
| (wt %) | 25 | 26 | 27 | 28 | 29 | 30 | 31 | 32 |
| Zn | 32.3 | 31.8 | 31.8 | 32.2 | 32.1 | 31.9 | 31.8 | 32.0 |
| Ni | 9.5 | 9.6 | 10.1 | 7.4 | 13.7 | 9.8 | 10.0 | 9.8 |
| Mn | 1.47 | 1.47 | 1.52 | 1.48 | 1.45 | 0.11 | 1.47 | 1.45 |
| Fe | 0.029 | 0.026 | 0.031 | 0.030 | 0.032 | 0.029 | 0.027 | 0.013 |
| P | 0.002 | 0.082 | 0.0007 | 0.003 | 0.002 | 0.004 | 0.002 | 0.002 |
| Si | — | — | — | — | — | — | — | — |
| Pb | — | — | — | — | — | — | — | — |
| C | 0.0004 | 0.0008 | 0.0012 | 0.0020 | 0.0047 | 0.0060 | 0.0075 | 0.0097 |
| Al | — | — | — | — | — | — | — | — |
| Mg | — | — | — | — | — | — | — | — |
| Sn | — | — | — | — | — | — | — | — |
| Ti | — | — | — | — | — | — | — | — |
| Cr | — | — | — | — | — | — | — | — |

TABLE 4-continued

| CHEMICAL COMPOSITION | Cu ALLOYS OF PRESENT INVENTION | | | | | | | |
|---|---|---|---|---|---|---|---|---|
| (wt %) | 25 | 26 | 27 | 28 | 29 | 30 | 31 | 32 |
| Zr | — | — | — | — | — | — | — | — |
| Ca | — | — | — | — | — | — | — | — |
| Be | — | — | — | — | — | — | — | — |
| V | — | — | — | — | — | — | — | — |
| Nb | — | — | — | — | — | — | — | — |
| Co | — | — | — | — | — | — | — | — |
| S | 0.0021 | 0.0014 | 0.0013 | 0.0012 | 0.0008 | 0.0022 | 0.0027 | 0.0016 |
| O | 0.0014 | 0.0008 | 0.0007 | 0.0016 | 0.0011 | 0.0007 | 0.0008 | 0.0014 |
| Cu | BAL. | BAL. | BAL. | BAL. | BAL. | BAL. | BAL. | BAL. |

TABLE 5

| CHEMICAL COMPOSITION | Cu ALLOYS OF PRESENT INVENTION | | | | | | | |
|---|---|---|---|---|---|---|---|---|
| (wt %) | 33 | 34 | 35 | 36 | 37 | 38 | 39 | 40 |
| Zn | 15.5 | 31.9 | 34.7 | 32.2 | 32.1 | 32.9 | 31.8 | 32.1 |
| Ni | 9.6 | 9.4 | 9.9 | 7.2 | 13.6 | 9.8 | 9.5 | 9.8 |
| Mn | 1.53 | 1.48 | 1.53 | 1.50 | 1.47 | 0.12 | 1.85 | 1.45 |
| Fe | 0.028 | 0.028 | 0.027 | 0.030 | 0.031 | 0.029 | 0.028 | 0.013 |
| P | 0.002 | 0.003 | 0.001 | 0.002 | 0.002 | 0.001 | 0.003 | 0.001 |
| Si | 0.001 | 0.005 | — | 0.001 | 0.024 | 0.075 | 0.085 | 0.105 |
| Pb | 0.001 | — | 0.0003 | 0.0003 | — | — | — | — |
| C | — | 0.001 | 0.0003 | 0.0003 | — | — | — | — |
| Al | — | — | — | — | 0.8 | — | — | — |
| Mg | — | — | — | — | — | 0.2 | — | — |
| Sn | — | — | — | — | — | — | 0.8 | — |
| Ti | — | — | — | — | — | — | — | 0.8 |
| Cr | — | — | — | — | — | — | — | — |
| Zr | — | — | — | — | — | — | — | — |
| Ca | — | — | — | — | — | — | — | — |
| Be | — | — | — | — | — | — | — | — |
| V | — | — | — | — | — | — | — | — |
| Nb | — | — | — | — | — | — | — | — |
| Co | — | — | — | — | — | — | — | — |
| S | 0.0011 | 0.0017 | 0.0025 | 0.0014 | 0.0022 | 0.0021 | 0.0018 | 0.0007 |
| O | 0.0012 | 0.0008 | 0.0012 | 0.0016 | 0.0011 | 0.0020 | 0.0007 | 0.0034 |
| Cu | BAL. | BAL. | BAL. | BAL. | BAL. | BAL. | BAL. | BAL. |

TABLE 6

| CHEMICAL COMPOSITION | Cu ALLOYS OF PRESENT INVENTION | | | | | | | |
|---|---|---|---|---|---|---|---|---|
| (wt %) | 41 | 42 | 43 | 44 | 45 | 46 | 47 | 48 |
| Zn | 15.1 | 31.9 | 34.9 | 32.2 | 32.1 | 31.9 | 31.8 | 32.2 |
| Ni | 10.1 | 9.9 | 9.9 | 7.3 | 13.5 | 9.8 | 10.0 | 9.8 |
| Mn | 1.51 | 1.47 | 1.52 | 1.49 | 1.47 | 0.14 | 1.95 | 1.47 |
| Fe | 0.026 | 0.027 | 0.027 | 0.029 | 0.031 | 0.031 | 0.030 | 0.011 |
| P | 0.002 | 0.003 | 0.003 | 0.002 | 0.003 | 0.001 | 0.002 | 0.003 |
| Si | 0.002 | 0.005 | — | 0.001 | 0.027 | 0.077 | 0.079 | 0.108 |
| Pb | 0.001 | — | 0.0004 | 0.0004 | — | — | — | — |
| C | — | 0.001 | 0.0003 | 0.0003 | — | — | — | — |
| Al | — | — | — | — | — | — | — | — |
| Mg | — | — | — | — | — | — | — | — |
| Sn | — | — | — | — | — | — | — | — |
| Ti | — | — | — | — | — | — | — | — |
| Cr | 0.3 | — | — | — | — | — | — | — |
| Zr | — | 0.15 | — | — | — | — | — | — |
| Ca | — | — | 0.01 | — | — | — | — | — |
| Be | — | — | — | 0.2 | — | — | — | — |
| V | — | — | — | — | 0.01 | — | — | — |
| Nb | — | — | — | — | — | 0.01 | — | — |
| Co | — | — | — | — | — | — | 0.8 | — |
| S | 0.0014 | 0.0008 | 0.0022 | 0.0025 | 0.0032 | 0.0015 | 0.0013 | 0.0018 |

TABLE 6-continued

| CHEMICAL COMPOSITION | Cu ALLOYS OF PRESENT INVENTION | | | | | | | |
|---|---|---|---|---|---|---|---|---|
| (wt %) | 41 | 42 | 43 | 44 | 45 | 46 | 47 | 48 |
| O | 0.0008 | 0.0017 | 0.0016 | 0.0009 | 0.0011 | 0.0008 | 0.0022 | 0.0007 |
| Cu | BAL. | BAL. | BAL. | BAL. | BAL. | BAL. | BAL. | BAL. |

TABLE 7

| CHEMICAL COMPOSITION | Cu ALLOYS OF PRESENT INVENTION | | | | | | | |
|---|---|---|---|---|---|---|---|---|
| (wt %) | 49 | 50 | 51 | 52 | 53 | 54 | 55 | 56 |
| Zn | 15.2 | 31.9 | 34.6 | 32.2 | 32.1 | 31.9 | 31.8 | 32.2 |
| Ni | 9.6 | 9.9 | 9.7 | 7.1 | 13.4 | 9.8 | 10.1 | 9.7 |
| Mn | 1.50 | 1.46 | 1.53 | 1.49 | 1.46 | 0.13 | 1.93 | 1.46 |
| Fe | 0.029 | 0.027 | 0.029 | 0.031 | 0.031 | 0.030 | 0.029 | 0.012 |
| P | 0.003 | 0.005 | 0.002 | 0.002 | 0.003 | 0.002 | 0.001 | 0.002 |
| Si | 0.001 | 0.006 | — | 0.002 | 0.024 | 0.072 | — | 0.103 |
| Pb | 0.001 | — | 0.0003 | 0.0003 | 0.011 | — | 0.013 | 0.0006 |
| C | — | 0.001 | 0.0003 | 0.0003 | — | 0.005 | 0.0009 | 0.0007 |
| Al | — | 0.5 | — | — | — | — | — | — |
| Mg | — | 0.2 | — | — | — | — | — | — |
| Sn | — | — | 0.5 | — | — | — | — | — |
| Ti | — | — | 0.2 | — | — | — | — | — |
| Cr | — | — | — | 0.3 | — | — | — | — |
| Zr | — | — | — | 0.1 | — | — | — | — |
| Ca | — | — | — | — | 0.01 | — | — | — |
| Be | — | — | — | — | 0.2 | — | — | — |
| V | — | — | — | — | — | 0.01 | — | — |
| Nb | — | — | — | — | — | 0.01 | — | — |
| Co | — | — | — | — | — | — | 0.5 | — |
| S | 0.0012 | 0.0014 | 0.0017 | 0.0011 | 0.0008 | 0.0025 | 0.0022 | 0.0014 |
| O | 0.0011 | 0.0008 | 0.0012 | 0.0014 | 0.0009 | 0.0006 | 0.0007 | 0.0012 |
| Cu | BAL. | BAL. | BAL. | BAL. | BAL. | BAL. | BAL. | BAL. |

TABLE 8

| CHEMICAL COMPOSITION | COMPARATIVE Cu ALLOYS | | | | | | CONVENTIONAL |
|---|---|---|---|---|---|---|---|
| (wt %) | 1 | 2 | 3 | 4 | 5 | 6 | Cu ALLOY |
| Zn | 15.3 | 24.9 | 34.8 | 32.2 | 32.1 | 31.9 | 32.1 |
| Ni | 9.7 | 9.8 | 9.9 | 7.7 | 13.2 | 9.8 | 10.1 |
| Mn | 1.02 | 0.96 | 1.01 | 1.49 | 1.47 | 0.12 | 1.47 |
| Fe | 0.26 | 0.24 | 0.21 | 0.033 | 0.028 | 0.029 | 0.029 |
| P | 0.042 | 0.046 | 0.048 | 0.003 | 0.002 | 0.003 | 0.002 |
| Si | *0.0005 | *1.2 | — | — | — | — | — |
| Pb | — | — | *0.0001 | *0.03 | — | — | — |
| C | — | — | — | — | *0.0001 | *0.02 | — |
| Al | — | — | — | — | — | — | — |
| Mg | — | — | — | — | — | — | — |
| Sn | — | — | — | — | — | — | — |
| Ti | — | — | — | — | — | — | — |
| Cr | — | — | — | — | — | — | — |
| Zr | — | — | — | — | — | — | — |
| Ca | — | — | — | — | — | — | — |
| Be | — | — | — | — | — | — | — |
| V | — | — | — | — | — | — | — |
| Nb | — | — | — | — | — | — | — |
| Co | — | — | — | — | — | — | — |
| S | 0.0014 | 0.0011 | 0.0007 | 0.0014 | *0.0004 | *0.0115 | 0.0014 |
| O | 0.0008 | 0.0012 | *0.0003 | 0.0119 | 0.0006 | 0.0021 | 0.0008 |
| Cu | BAL. | BAL. | BAL. | BAL. | BAL. | BAL. | BAL. |

NOTE: Asterisked values fall outside the range according to the present invention.

To evaluate the properties suitable for use as a key material, the Cu alloy sheets Nos. 1 to 56 according to the present invention, the comparative Cu alloy sheets Nos. 1 to 6, and the conventional Cu alloy sheet, each having a width of 3 mm, were each subjected to measurements as to tensile strength, elongation, and Vickers hardness, and to evaluate the blankability of the same sheets, the rupture section ratio of the blankout section was measured after blanking or stamping the cu alloy sheets. Further, to evaluate the corrosion resistance, a salt water spray test (JIS Z2371) was conducted by spraying salt water onto the cu alloy sheets for 96 hours, to thereby measure the maximum corrosion depth. Then, to evaluate the same property, a perspiration resistance test (JIS L0848D Method) was conducted by soaking the Cu alloy sheets in the air at room temperature for 24 hours, to thereby observe the surface appearance of each of the Cu alloy sheets. The results are shown in Tables 9 to 15. The blanking or stamping was carried out by using a high-speed steel die containing 18% W, 4% Cr, and 1% V, and having a clearance of 0.06 mm.

TABLE 9

| TEST PIECES | PROPERTIES OF Cu ALLOY SHEETS HAVING THICKNESS OF 3 mm | | | | | |
|---|---|---|---|---|---|---|
| | TENSIL STRENGTH (N/mm2) | ELONGATION (%) | HARDNESS Hv | RUPTURE SECTION RATIO OF BLANK-OUT SURFACE (%) | MAXIMUM CORROSION DEPTH (μm) | SURFACE APPEARANCE |
| Cu ALLOYS OF PRESENT INVENTION | | | | | | |
| 1 | 610 | 19 | 182 | 76 | 1.1 | METALLIC LUSTER OVER ENTIRE SURFACE |
| 2 | 625 | 18 | 187 | 78 | 1.1 | METALLIC LUSTER OVER ENTIRE SURFACE |
| 3 | 670 | 20 | 200 | 81 | 1.1 | METALLIC LUSTER OVER ENTIRE SURFACE |
| 4 | 650 | 18 | 194 | 85 | 1.2 | METALLIC LUSTER OVER ENTIRE SURFACE |
| 5 | 690 | 19 | 205 | 87 | 0.9 | METALLIC LUSTER OVER ENTIRE SURFACE |
| 6 | 635 | 20 | 189 | 89 | 1.2 | METALLIC LUSTER OVER ENTIRE SURFACE |
| 7 | 675 | 21 | 202 | 92 | 0.8 | METALLIC LUSTER OVER ENTIRE SURFACE |
| 8 | 665 | 22 | 198 | 93 | 1.0 | METALLIC LUSTER OVER ENTIRE SURFACE |
| 9 | 670 | 21 | 201 | 93 | 1.0 | METALLIC LUSTER OVER ENTIRE SURFACE |
| 10 | 675 | 20 | 202 | 95 | 1.1 | METALLIC LUSTER OVER ENTIRE SURFACE |

TABLE 10

| TEST PIECES | PROPERTIES OF Cu ALLOY SHEETS HAVING THICKNESS OF 3 mm | | | | | |
|---|---|---|---|---|---|---|
| | TENSIL STRENGTH (N/mm2) | ELONGATION (%) | HARDNESS Hv | RUPTURE SECTION RATIO OF BLANK-OUT SURFACE (%) | MAXIMUM CORROSION DEPTH (μm) | SURFACE APPEARANCE |
| Cu ALLOYS OF PRESENT INVENTION | | | | | | |
| 11 | 690 | 19 | 206 | 97 | 1.1 | METALLIC LUSTER OVER ENTIRE SURFACE |
| 12 | 665 | 19 | 198 | 97 | 1.2 | METALLIC LUSTER OVER ENTIRE SURFACE |
| 13 | 685 | 21 | 205 | 76 | 0.8 | METALLIC LUSTER OVER ENTIRE SURFACE |
| 14 | 630 | 22 | 188 | 78 | 1.2 | METALLIC LUSTER OVER ENTIRE SURFACE |
| 15 | 670 | 21 | 200 | 80 | 0.9 | METALLIC LUSTER OVER ENTIRE SURFACE |
| 16 | 660 | 20 | 197 | 83 | 1.1 | METALLIC LUSTER OVER ENTIRE SURFACE |
| 17 | 660 | 16 | 196 | 84 | 1.1 | METALLIC LUSTER OVER ENTIRE SURFACE |
| 18 | 665 | 18 | 199 | 86 | 0.9 | METALLIC LUSTER OVER ENTIRE SURFACE |
| 19 | 660 | 21 | 197 | 86 | 1.0 | METALLIC LUSTER OVER ENTIRE SURFACE |
| 20 | 645 | 20 | 192 | 88 | 1.0 | METALLIC LUSTER OVER ENTIRE SURFACE |

TABLE 11

| TEST PIECES | PROPERTIES OF Cu ALLOY SHEETS HAVING THICKNESS OF 3 mm | | | | | |
|---|---|---|---|---|---|---|
| | TENSIL STRENGTH (N/mm2) | ELONGATION (%) | HARDNESS Hv | RUPTURE SECTION RATIO OF BLANK-OUT SURFACE (%) | MAXIMUM CORROSION DEPTH (μm) | SURFACE APPEARANCE |
| Cu ALLOYS OF PRESENT INVENTION | | | | | | |
| 21 | 685 | 21 | 204 | 90 | 0.8 | METALLIC LUSTER OVER ENTIRE SURFACE |
| 22 | 630 | 21 | 188 | 92 | 1.2 | METALLIC LUSTER OVER ENTIRE SURFACE |
| 23 | 675 | 18 | 201 | 94 | 0.8 | METALLIC LUSTER OVER ENTIRE SURFACE |
| 24 | 660 | 16 | 196 | 94 | 1.0 | METALLIC LUSTER OVER ENTIRE SURFACE |
| 25 | 660 | 20 | 197 | 75 | 1.0 | METALLIC LUSTER OVER ENTIRE SURFACE |
| 26 | 660 | 20 | 197 | 78 | 1.1 | METALLIC LUSTER OVER ENTIRE SURFACE |
| 27 | 660 | 19 | 198 | 81 | 1.0 | METALLIC LUSTER OVER ENTIRE SURFACE |
| 28 | 645 | 20 | 192 | 82 | 1.2 | METALLIC LUSTER OVER ENTIRE SURFACE |
| 29 | 685 | 19 | 204 | 88 | 0.8 | METALLIC LUSTER OVER ENTIRE SURFACE |
| 30 | 630 | 18 | 188 | 90 | 1.2 | METALLIC LUSTER OVER ENTIRE SURFACE |

TABLE 12

| TEST PIECES | PROPERTIES OF Cu ALLOY SHEETS HAVING THICKNESS OF 3 mm | | | | | |
|---|---|---|---|---|---|---|
| | TENSIL STRENGTH (N/mm2) | ELONGATION (%) | HARDNESS Hv | RUPTURE SECTION RATIO OF BLANK-OUT SURFACE (%) | MAXIMUM CORROSION DEPTH (μm) | SURFACE APPEARANCE |
| Cu ALLOYS OF PRESENT INVENTION | | | | | | |
| 31 | 660 | 18 | 197 | 95 | 1.0 | METALLIC LUSTER OVER ENTIRE SURFACE |
| 32 | 660 | 17 | 198 | 96 | 1.0 | METALLIC LUSTER OVER ENTIRE SURFACE |
| 33 | 620 | 19 | 185 | 78 | 1.1 | METALLIC LUSTER OVER ENTIRE SURFACE |
| 34 | 660 | 19 | 197 | 80 | 1.0 | METALLIC LUSTER OVER ENTIRE SURFACE |
| 35 | 685 | 20 | 205 | 77 | 1.1 | METALLIC LUSTER OVER ENTIRE SURFACE |
| 36 | 645 | 21 | 192 | 78 | 1.2 | METALLIC LUSTER OVER ENTIRE SURFACE |
| 37 | 705 | 19 | 211 | 81 | 0.8 | METALLIC LUSTER OVER ENTIRE SURFACE |
| 38 | 630 | 20 | 188 | 86 | 1.2 | METALLIC LUSTER OVER ENTIRE SURFACE |
| 39 | 675 | 21 | 202 | 86 | 1.1 | METALLIC LUSTER OVER ENTIRE SURFACE |
| 40 | 675 | 18 | 203 | 88 | 1.0 | METALLIC LUSTER OVER ENTIRE SURFACE |

TABLE 13

| TEST PIECES | PROPERTIES OF Cu ALLOY SHEETS HAVING THICKNESS OF 3 mm | | | | | |
|---|---|---|---|---|---|---|
| | TENSIL STRENGTH (N/mm2) | ELONGATION (%) | HARDNESS Hv | RUPTURE SECTION RATIO OF BLANK-OUT SURFACE (%) | MAXIMUM CORROSION DEPTH (μm) | SURFACE APPEARANCE |
| Cu ALLOYS OF PRESENT INVENTION | | | | | | |
| 41 | 620 | 20 | 185 | 78 | 1.1 | METALLIC LUSTER OVER ENTIRE SURFACE |
| 42 | 660 | 21 | 198 | 80 | 1.0 | METALLIC LUSTER OVER ENTIRE SURFACE |
| 43 | 685 | 19 | 204 | 77 | 1.1 | METALLIC LUSTER OVER ENTIRE SURFACE |
| 44 | 645 | 19 | 192 | 79 | 1.0 | METALLIC LUSTER OVER ENTIRE SURFACE |
| 45 | 685 | 19 | 205 | 82 | 0.9 | METALLIC LUSTER OVER ENTIRE SURFACE |
| 46 | 630 | 21 | 189 | 86 | 1.2 | METALLIC LUSTER OVER ENTIRE SURFACE |
| 47 | 670 | 20 | 200 | 88 | 0.8 | METALLIC LUSTER OVER ENTIRE SURFACE |
| 48 | 665 | 21 | 198 | 87 | 1.0 | METALLIC LUSTER OVER ENTIRE SURFACE |
| 49 | 620 | 19 | 185 | 78 | 1.0 | METALLIC LUSTER OVER ENTIRE SURFACE |
| 50 | 720 | 18 | 216 | 82 | 1.1 | METALLIC LUSTER OVER ENTIRE SURFACE |

TABLE 14

| TEST PIECES | PROPERTIES OF Cu ALLOY SHEETS HAVING THICKNESS OF 3 mm | | | | | |
|---|---|---|---|---|---|---|
| | TENSIL STRENGTH (N/mm2) | ELONGATION (%) | HARDNESS Hv | RUPTURE SECTION RATIO OF BLANK-OUT SURFACE (%) | MAXIMUM CORROSION DEPTH (μm) | SURFACE APPEARANCE |
| Cu ALLOYS OF PRESENT INVENTION | | | | | | |
| 51 | 715 | 21 | 214 | 77 | 1.3 | METALLIC LUSTER OVER ENTIRE SURFACE |
| 52 | 690 | 20 | 206 | 79 | 1.1 | METALLIC LUSTER OVER ENTIRE SURFACE |
| 53 | 710 | 20 | 212 | 83 | 0.9 | METALLIC LUSTER OVER ENTIRE SURFACE |
| 54 | 650 | 19 | 194 | 88 | 1.2 | METALLIC LUSTER OVER ENTIRE SURFACE |
| 55 | 710 | 20 | 212 | 91 | 0.9 | METALLIC LUSTER OVER ENTIRE SURFACE |
| 56 | 665 | 21 | 198 | 90 | 1.0 | METALLIC LUSTER OVER ENTIRE SURFACE |

TABLE 15

| TEST PIECES | PROPERTIES OF Cu ALLOY SHEETS HAVING THICKNESS OF 3 mm | | | | | |
|---|---|---|---|---|---|---|
| | TENSIL STRENGTH (N/mm2) | ELONGATION (%) | HARDNESS Hv | RUPTURE SECTION RATIO OF BLANK-OUT SURFACE (%) | MAXIMUM CORROSION DEPTH (μm) | SURFACE APPEARANCE |
| COMPARATIVE Cu ALLOYS | | | | | | |
| 1 | 620 | 20 | 185 | 70 | 1.1 | METALLIC LUSTER OVER ENTIRE SURFACE |
| 2 | 635 | 14 | 189 | 98 | 1.1 | *METALLIC LUSTER OVER ENTIRE SURFACE |
| 3 | 670 | 19 | 200 | 68 | 1.0 | METALLIC LUSTER OVER ENTIRE SURFACE |

TABLE 15-continued

| TEST PIECES | PROPERTIES OF Cu ALLOY SHEETS HAVING THICKNESS OF 3 mm | | | | | |
|---|---|---|---|---|---|---|
| | TENSIL STRENGTH (N/mm2) | ELONGATION (%) | HARDNESS Hv | RUPTURE SECTION RATIO OF BLANK-OUT SURFACE (%) | MAXIMUM CORROSION DEPTH (μm) | SURFACE APPEARANCE |
| 4 | 650 | 18 | 194 | 96 | 1.1 | *METALLIC LUSTER OVER ENTIRE SURFACE |
| 5 | 685 | 18 | 204 | 68 | 0.9 | METALLIC LUSTER OVER ENTIRE SURFACE |
| 6 | 630 | 12 | 188 | 97 | 1.2 | *METALLIC LUSTER OVER ENTIRE SURFACE |
| CONVENTIONAL Cu ALLOY | 660 | 20 | 198 | 63 | 1.1 | METALLIC LUSTER OVER ENTIRE SURFACE |

NOTE: The comparative Cu alloys 2, 4 and 6 each have evaluation of "*METALLIC LUSTER OVER ENTIRE SURFACE" as the surface appearance, which means that the Cu alloys were actually of no use due to formation of many cracks during hot rolling though the metallic luster is exhibited over the entire surface thereof.

As is clear from the results of Tables 9 to 15, the Cu alloys Nos. 1 to 56 according to the present invention all have strength and corrosion resistance equal to or superior to those of the conventional Cu alloy, and at the same time exhibit more excellent blankability than that of the conventional Cu alloy. On the other hand, it should be noted that the comparative Cu alloys Nos. 1 to 6, each having at least one of the component elements falling outside the range of the present invention, are inferior either in blankability or hot rollability to the Cu alloys according to the present invention.

EXAMPLE 2

The cold rolled sheets having a thickness of 3 mm obtained in Example 1 by cold rolling the hot rolled sheets were repeatedly subjected to annealing at a predetermined temperature within a range of 400° to 600° C. for one hour and cold rolling, and then the resulting sheets were pickled and polished, followed by final cold rolling to obtain Cu alloy sheets having a thickness of 0.15 mm. Further, the Cu alloy sheets were subjected to low-temperature annealing at 300° C. for one hour, to thereby produce Cu alloy sheets Nos. 1 to 56 according to the invention, comparative Cu alloy sheets Nos. 1 to 6, and a conventional Cu alloy sheet. To evaluate properties for electrical and electronic parts and a spring material, these sheets were measured as to the tensile strength, elongation, hardness, and electric conductivity. Further, these sheets were measured as to springiness in accordance with the method of JISH3130. The results are shown in Tables 16 to 22.

Further, to evaluate the blankability of these sheets, the amount of wear of the die was measured, and the results of the measurement are also shown in Tables 16 to 22. The amount of wear of the die was measured by employing a commercially available die formed of a WC based hard metal in the following manner: One million circular chips with a diameter of 5 mm were blanked or punched from each of the Cu alloy sheets. 20 chips obtained immediately after the start of the blanking and 20 chips obtained immediately before the termination of the same were selected, the diameters of which were measured. An amount of change in the diameter was determined from two average diameter values of the respective groups of 20 chips, to adopt it as the amount of wear. The amount of wear of the conventional Cu alloy sheet obtained by blanking and measurement in the same manner as above was set as a reference value of 1, and the wear amounts of the other Cu alloy sheets were converted into values of a ratio relative to the reference value, as shown in Tables 16 to 22.

TABLE 16

| TEST PIECES | PROPERTIES OF Cu ALLOY SHEETS HAVING THICKNESS OF 1.5 mm | | | | | |
|---|---|---|---|---|---|---|
| | TENSIL STRENGTH (N/mm2) | ELON-GATION (%) | HARDNESS Hv | ELECTRIC CONDUC-TIVITY (IACS %) | SPRIN-GINESS (N/mm2) | WEAR AMOUNT OF METALLIC DIE [RELATIVE VALUE] |
| Cu ALLOYS OF PRESENT INVENTION | | | | | | |
| 1 | 630 | 15 | 188 | 9 | 470 | 0.86 |
| 2 | 640 | 15 | 191 | 8 | 485 | 0.82 |
| 3 | 685 | 17 | 204 | 7 | 535 | 0.78 |
| 4 | 670 | 14 | 200 | 8 | 530 | 0.75 |
| 5 | 710 | 15 | 212 | 6 | 570 | 0.71 |
| 6 | 655 | 17 | 196 | 8 | 505 | 0.70 |
| 7 | 690 | 17 | 206 | 7 | 560 | 0.68 |
| 8 | 685 | 17 | 205 | 7 | 550 | 0.68 |
| 9 | 690 | 16 | 206 | 7 | 555 | 0.67 |
| 10 | 700 | 15 | 209 | 6 | 565 | 0.66 |

TABLE 17

| TEST PIECES | PROPERTIES OF Cu ALLOY SHEETS HAVING THICKNESS OF 1.5 mm | | | | | |
|---|---|---|---|---|---|---|
| | TENSIL STRENGTH (N/mm2) | ELON-GATION (%) | HARDNESS Hv | ELECTRIC CONDUC-TIVITY (IACS %) | SPRIN-GINESS (N/mm2) | WEAR AMOUNT OF METALLIC DIE [RELATIVE VALUE] |
| Cu ALLOYS OF PRESENT INVENTION | | | | | | |
| 11 | 710 | 15 | 212 | 6 | 570 | 0.65 |
| 12 | 680 | 16 | 203 | 6 | 550 | 0.65 |
| 13 | 705 | 17 | 210 | 6 | 560 | 0.84 |
| 14 | 650 | 17 | 195 | 8 | 545 | 0.80 |
| 15 | 695 | 16 | 207 | 7 | 555 | 0.79 |
| 16 | 675 | 17 | 202 | 7 | 530 | 0.77 |
| 17 | 680 | 13 | 204 | 7 | 530 | 0.76 |
| 18 | 690 | 14 | 206 | 7 | 540 | 0.73 |
| 19 | 680 | 17 | 203 | 7 | 525 | 0.72 |
| 20 | 665 | 16 | 198 | 7 | 510 | 0.72 |

TABLE 18

| TEST PIECES | PROPERTIES OF Cu ALLOY SHEETS HAVING THICKNESS OF 1.5 mm | | | | | |
|---|---|---|---|---|---|---|
| | TENSIL STRENGTH (N/mm2) | ELON-GATION (%) | HARDNESS Hv | ELECTRIC CONDUC-TIVITY (IACS %) | SPRIN-GINESS (N/mm2) | WEAR AMOUNT OF METALLIC DIE [RELATIVE VALUE] |
| Cu ALLOYS OF PRESENT INVENTION | | | | | | |
| 21 | 700 | 17 | 210 | 6 | 555 | 0.71 |
| 22 | 650 | 17 | 194 | 8 | 495 | 0.68 |
| 23 | 695 | 14 | 207 | 7 | 550 | 0.68 |
| 24 | 680 | 13 | 203 | 7 | 530 | 0.67 |
| 25 | 685 | 15 | 204 | 7 | 550 | 0.85 |
| 26 | 680 | 17 | 203 | 7 | 535 | 0.82 |
| 27 | 675 | 16 | 201 | 7 | 530 | 0.78 |
| 28 | 665 | 17 | 199 | 7 | 510 | 0.76 |
| 29 | 705 | 15 | 211 | 6 | 565 | 0.75 |
| 30 | 650 | 14 | 195 | 8 | 500 | 0.72 |

TABLE 19

| TEST PIECES | PROPERTIES OF Cu ALLOY SHEETS HAVING THICKNESS OF 1.5 mm | | | | | |
|---|---|---|---|---|---|---|
| | TENSIL STRENGTH (N/mm2) | ELON-GATION (%) | HARDNESS Hv | ELECTRIC CONDUC-TIVITY (IACS %) | SPRIN-GINESS (N/mm2) | WEAR AMOUNT OF METALLIC DIE [RELATIVE VALUE] |
| Cu ALLOYS OF PRESENT INVENTION | | | | | | |
| 31 | 680 | 14 | 203 | 7 | 535 | 0.68 |
| 32 | 685 | 13 | 205 | 7 | 540 | 0.66 |
| 33 | 640 | 16 | 191 | 9 | 490 | 0.85 |
| 34 | 680 | 16 | 202 | 7 | 540 | 0.79 |
| 35 | 705 | 16 | 211 | 7 | 565 | 0.80 |
| 36 | 665 | 17 | 199 | 7 | 510 | 0.82 |
| 37 | 725 | 16 | 217 | 6 | 585 | 0.82 |
| 38 | 650 | 14 | 194 | 8 | 505 | 0.74 |
| 39 | 700 | 16 | 210 | 6 | 565 | 0.70 |
| 40 | 695 | 14 | 208 | 7 | 545 | 0.75 |

TABLE 20

| TEST PIECES | PROPERTIES OF Cu ALLOY SHEETS HAVING THICKNESS OF 1.5 mm | | | | | |
|---|---|---|---|---|---|---|
| | TENSIL STRENGTH (N/mm2) | ELON-GATION (%) | HARDNESS Hv | ELECTRIC CONDUC-TIVITY (IACS %) | SPRIN-GINESS (N/mm2) | WEAR AMOUNT OF METALLIC DIE [RELATIVE VALUE] |
| Cu ALLOYS OF PRESENT INVENTION | | | | | | |
| 41 | 640 | 16 | 191 | 9 | 495 | 0.85 |
| 42 | 680 | 17 | 203 | 7 | 540 | 0.81 |
| 43 | 705 | 16 | 210 | 7 | 560 | 0.80 |
| 44 | 665 | 15 | 199 | 7 | 530 | 0.79 |
| 45 | 700 | 17 | 209 | 6 | 560 | 0.77 |
| 46 | 650 | 17 | 193 | 8 | 495 | 0.73 |
| 47 | 690 | 16 | 206 | 6 | 555 | 0.76 |
| 48 | 685 | 17 | 204 | 7 | 550 | 0.72 |
| 49 | 640 | 16 | 192 | 9 | 490 | 0.81 |
| 50 | 740 | 15 | 223 | 6 | 590 | 0.81 |

TABLE 21

| TEST PIECES | PROPERTIES OF Cu ALLOY SHEETS HAVING THICKNESS OF 1.5 mm | | | | | |
|---|---|---|---|---|---|---|
| | TENSIL STRENGTH (N/mm2) | ELON-GATION (%) | HARDNESS Hv | ELECTRIC CONDUC-TIVITY (IACS %) | SPRIN-GINESS (N/mm2) | WEAR AMOUNT OF METALLIC DIE [RELATIVE VALUE] |
| Cu ALLOYS OF PRESENT INVENTION | | | | | | |
| 51 | 730 | 17 | 220 | 6 | 585 | 0.82 |
| 52 | 705 | 16 | 210 | 7 | 565 | 0.82 |
| 53 | 725 | 16 | 218 | 6 | 580 | 0.77 |
| 54 | 670 | 16 | 199 | 8 | 530 | 0.72 |
| 55 | 730 | 17 | 218 | 6 | 585 | 0.76 |
| 56 | 685 | 17 | 205 | 7 | 540 | 0.71 |

TABLE 22

| TEST PIECES | PROPERTIES OF Cu ALLOY SHEETS HAVING THICKNESS OF 1.5 mm | | | | | |
|---|---|---|---|---|---|---|
| | TENSIL STRENGTH (N/mm2) | ELON-GATION (%) | HARDNESS Hv | ELECTRIC CONDUC-TIVITY (IACS %) | SPRIN-GINESS (N/mm2) | WEAR AMOUNT OF METALLIC DIE [RELATIVE VALUE] |
| COMPARATIVE Cu ALLOYS | | | | | | |
| 1 | 640 | 16 | 191 | 9 | 475 | 0.92 |
| 2 | 650 | 11 | 193 | 7 | 500 | *0.66 |
| 3 | 690 | 15 | 204 | 7 | 540 | 0.93 |
| 4 | 670 | 14 | 200 | 7 | 525 | *0.67 |
| 5 | 705 | 14 | 210 | 6 | 565 | 0.94 |
| 6 | 645 | 10 | 193 | 8 | 490 | *0.66 |
| CONVENTIONAL Cu ALLOY | 680 | 16 | 203 | 7 | 530 | 1 |

NOTE : Asterisked values of the comparative Cu alloys 2, 4 and 6 indicate that these Cu alloys 2, 4 and 6 were actually of no use due to formation of many cracks during hot rolling because of many cracks generated during hot rolling.

It will be learned from Tables 1 to 8 and 16 to 22 that the Cu alloy sheets having a thickness of 0.15 mm formed of the Cu alloys Nos. 1 to 56 according to the present invention exhibit much smaller amounts of wear than the amount of wear of the conventional Cu alloy sheet having a thickness of 0.15 mm and hence they are excellent in blankability, which leads to curtailment of the manufacturing cost when they are used as materials for electrical and electronic parts and springs. The comparative Cu alloys Nos. 1, 3 and 5, of which the content of one or more of the component elements falls on the smaller side than the range of the present invention, however, exhibit inferior blankability, whereby it is impossible to reduce the wear of the die and hence curtail the manufacturing cost. On the other hand, the comparative Cu alloys Nos. 2, 4 and 6, of which the content of one or more of the component elements falls on the larger side than the range of the present invention, suffer from cracks due to hot rolling, resulting in that these alloys are not applicable for use as materials for industrial products.

As described hereinabove, Cu alloys according to the present invention are excellent in blankability, while exhibiting strength and corrosion resistance as high as or higher than those of the conventional Cu alloy. As a result, the Cu alloys according to the present invention are applicable for use as various materials in the industrial field, such as materials for keys, electrical and electronic parts, and springs. Especially, they bring about industrially useful effects when used as materials for keys.

What is claimed is:

1. A copper based alloy having excellent blankability as well as good corrosion resistance and high strength, consisting essentially, by weight %, of:

15 to 35% Zn, 7 to 14% Ni, 0.1 to 2% exclusive Mn, 0.01 to 0.5% Fe, 0.0005 to 0.1% P, 0.001 to 0.9% Si, at least one element selected from the group consisting of 0.0003 to 0.02% Pb and 0.0003 to 0.01% C, and the balance of Cu and inevitable impurities.

2. A copper based alloy having excellent blankability as well as good corrosion resistance and high strength, consisting essentially, by weight %, of:

15 to 35% Zn, 7 to 14% Ni, 0.1 to 2% exclusive Mn, 0.01 to 0.5% Fe, 0.0005 to 0.1% P, 0.0003 to 0.02% Pb, and the balance of Cu and inevitable impurities.

3. A copper based alloy having excellent blankability as well as good corrosion resistance and high strength, consisting essentially, by weight %, of:

15 to 35% Zn, 7 to 14% Ni, 0.1 to 2% exclusive Mn, 0.01 to 0.5% Fe, 0.0005 to 0.1% P, 0.0003 to 0.01% C, and the balance of Cu and inevitable impurities.

4. A copper based alloy having excellent blankability as well as good corrosion resistance and high strength, consisting essentially, by weight %, of:

15 to 35% Zn, 7 to 14% Ni, 0.1 to 2% exclusive Mn, 0.01 to 0.5% Fe, 0.0005 to 0.1% P, 0.0006 to 0.9% in total at least two elements selected from the group consisting of 0.001 to 0.9% Si, 0.0003 to 0.02% Pb, and 0.0003 to 0.01% C, and the balance of Cu and inevitable impurities.

5. A copper based alloy as claimed in any of claims 1 to 4, further including 0.01 to 2% in total at least one element selected from the group consisting of Al, Mg, Sn, Ti, Cr, Zr, Ca, Be, V, Nb, and Co.

6. A copper based alloy having excellent blankability as well as good corrosion resistance and high strength, consisting essentially, by weight %, of:

30 to 34% Zn, 8 to 12% Ni, 0.5 to 1.8% Ma, 0.02 to 0.2% Fe, 0.001 to 0.01% P, 0.004 to 0.3% Si, at least one element selected from the group consisting of 0.0003 to 0.02% Pb and 0.0003 to 0.01% C, and the balance of Cu and inevitable impurities.

7. A copper based alloy having excellent blankability as well as good corrosion resistance and high strength, consisting essentially, by weight %, of:

30 to 34% Zn, 8 to 12% Ni, 0.5 to 1.8% Mn, 0.02 to 0.2% Fe, 0.001 to 0.01% P, 0.0006 to 0.008% Pb, and the balance of Cu and inevitable impurities.

8. A copper based alloy having excellent blankability as well as good corrosion resistance and high strength, consisting essentially, by weight %, of:

30 to 34% Zn, 8 to 12% Ni, 0.5 to 1.8% Mn, 0.02 to 0.2% Fe, 0.001 to 0.01% P, 0.0005 to 0.005% C, and the balance of Cu and inevitable impurities.

9. A copper based alloy having excellent blankability as well as good corrosion resistance and high strength, consisting essentially, by weight %, of:

30 to 34% Zn, 8 to 12% Ni, 0.5 to 1.8% Mn, 0.02 to 0.2% Fe, 0.001 to 0.01% P, 0.001 to 0.3% in total at least two elements selected from the group consisting of 0.004 to 0.3% Si, 0.0006 to 0.008% Pb, and 0.0005 to 0.005% C, and the balance of Cu and inevitable impurities.

10. A copper based alloy as claimed in any of claims 6 to 9, further including 0.06 to 0.9% in total at least one element selected from the group consisting of Al, Mg, Sn, Ti, Cr, Zr, Ca, Be, V, Nb, and Co.

11. A copper based alloy as claimed in any of c1aims 1 to 4 and 6 to 9, wherein said inevitable impurities contain 0.0005 to 0.01% S and 0.0005 to 0.01% O.

12. A material for keys formed of a copper based alloy as claimed in any of claims 1 to 4 and 6 to 9.

13. A material for electrical and electronic parts formed of a copper based alloy as claimed in any of claims 1 to 4 and 6 to 9.

14. A copper based alloy as claimed in claim 5, wherein said inevitable impurities contain 0.0005 to 0.01% S and 0.0005 to 0.01% O.

15. A copper based alloy as claimed in claim 10, wherein said inevitable impurities contain 0.0005 to 0.01% S and 0.0005 to 0.01% O.

16. A material for keys formed of a copper based alloy as claimed in claim 5.

17. A material for keys formed of a copper based alloy as claimed in claim 10.

18. A material for keys formed of a copper based alloy as claimed in claim 11.

19. A material for electrical and electronic parts formed of a copper based alloy as claimed in claim 5.

20. A material for electrical and electronic parts formed of a copper based alloy as claimed in claim 10.

21. A material for electrical and electronic parts formed of a copper based alloy as claimed in claim 11.

* * * * *